United States Patent [19]

Wada et al.

[11] 4,254,804

[45] Mar. 10, 1981

[54] FILLING DEVICE FOR FILLING CONTAINERS

[75] Inventors: Yoshinobu Wada, Matsutoh; Shigeru Yoshida, Kanazawa, both of Japan

[73] Assignee: Shibuya Kogyo Company, Ltd., Kanazawa, Japan

[21] Appl. No.: 40,371

[22] Filed: May 18, 1979

[30] Foreign Application Priority Data

May 19, 1978 [JP] Japan ..... 53-59783

[51] Int. Cl.[3] ..... B65B 3/26

[52] U.S. Cl. ..... 141/40; 141/54; 141/302

[58] Field of Search ..... 141/5, 6, 39, 40, 46, 141/54–58, 95, 96, 198, 214, 225, 226, 302, 392

[56] References Cited

U.S. PATENT DOCUMENTS

| | | | |
|---|---|---|---|
| 2,605,949 | 8/1952 | Stern | 141/54 X |
| 3,527,267 | 9/1970 | Moore | 141/198 X |
| 3,893,493 | 1/1975 | Foirest et al. | 141/95 X |

*Primary Examiner*—Frederick R. Schmidt
*Attorney, Agent, or Firm*—Blanchard, Flynn, Thiel, Boutell & Tanis

[57] ABSTRACT

A filling device for use in a bottling machine, which device is provided with a sealing member for closing the opening of a bottle, a filling tube for supplying the bottle with a filling liquid and an exhaust tube for discharging the air from the bottle to the outside during the filling operation. When the opening of the bottle is closed by the sealing member, the filling liquid is fed into the bottle through the filling tube and the air in the bottle is simultaneously discharged outside. The filling device is provided with a valve mechanism which receives the pressure of the air remaining in the bottle as an indication pressure when the filling liquid in the bottle blocks the lower end of the exhaust tube. The valve mechanism closes the exhaust tube or the filling tube when the indication pressure exceeds a predetermined value.

7 Claims, 6 Drawing Figures

FILLING DEVICE FOR FILLING CONTAINERS

BACKGROUND OF THE INVENTION (1) Field of the Invention

This invention relates to a filling device for use in a bottling machine. More particularly, the invention relates to a filling device which is able to fill a bottle with a predetermined quantity of liquid product.

(2) Description of the Prior Art

In a conventional bottle filling machine, it is well known that the opening of a bottle to be filled is closed by a sealing member and, under such a state, a filling liquid is fed into the bottle from a filling tube and at the same time, the air in the bottle is discharged through an exhaust tube. In a filling machine of this type, when the surface of the liquid that is supplied into the bottle reaches the lower end of the exhaust tube, the liquid is allowed to enter into the exhaust tube after that, and the filling operation is automatically stopped when the liquid surface level in the exhaust tube coincides with the surface level of the liquid in a reservoir tank. Further, the closing of the bottle with the sealing member is then released by closing the filling tube and the liquid in the exhaust tube is fed into the above bottle, thereby accomplishing the filling of a constant quantity of the liquid.

However, in the above-described filling system, since the filling liquid is introduced into the exhaust tube until the surface level thereof reaches the surface level of the liquid in the tank, the liquid surface in the tank must be maintained at a fixed level. Therefore, the filling takes a long time and some device to maintain the liquid surface level constant is required.

BRIEF SUMMARY OF THE INVENTION

The present invention has been accomplished in view of the fact that, when the liquid surface reaches the lowermost end of the exhaust tube and the liquid blocks the end of the exhaust tube, the pressure of the air in the remaining space of the bottle is increased. In the present invention, the increased pressure is utilized as an indication pressure and when the pressure exceeds a certain value, the exhaust tube or the filling tube is closed by the valve mechanism.

It is, therefore, the primary object of the present invention to provide an improved filling device which is free from the above described disadvantages in the conventional art.

Another object of the present invention is to provide a filling device for use in a bottling machine which device is accurate, sensitive and reliable in the filling operation and does not require the controlling of the surface level of the liquid in the reservoir tank.

A further object of the present invention is to provide a filling device which is simple in structure, easy to operate and durable.

According to the present invention, the filling device is of the type which is provided with a sealing member which closes the opening of a bottle, a filling tube which supplies the bottle with a filling liquid, and an exhaust tube which discharges the air from the bottle to the outside during the filling operation. When the opening of the bottle is closed by the sealing member, the filling liquid is fed into the bottle through the filling tube and the air in the bottle is simultaneously discharged outside. The improvement in the filling device is characterized by the feature that the filling device is provided with a valve mechanism which receives the pressure of the air remaining in the bottle as an indication pressure when the filling liquid in the bottle blocks the lower end of the exhaust tube. The valve mechanism closes the exhaust tube or the filling tube when the indication pressure exceeds a predetermined value. Furthermore, the above valve mechanism has a cavity which is divided into two chambers by a diaphragm and when the indication pressure above the predetermined value is applied to one of the chambers, the diaphragm is deformed toward the other chamber to close the exhaust tube. In another embodiment of the present invention, the valve mechanism is provided with a spring actuated slidable plunger which is connected to a limit switch. The plunger is shifted by the above-mentioned indication pressure and the limit switch is actuated by the plunger, thereby closing the filling tube.

BRIEF DESCRIPTION OF THE DRAWINGS

The nature, principle and details of the invention will be more clearly apparent from the following detailed description with respect to preferred embodiments of the invention with the accompanying drawings, in which.

DETAILED DESCRIPTION OF PREFERRED EMBODIMENTS

Referring to the accompanying drawings, the embodiments of the present invention will now be described in detail.

Figure 1:
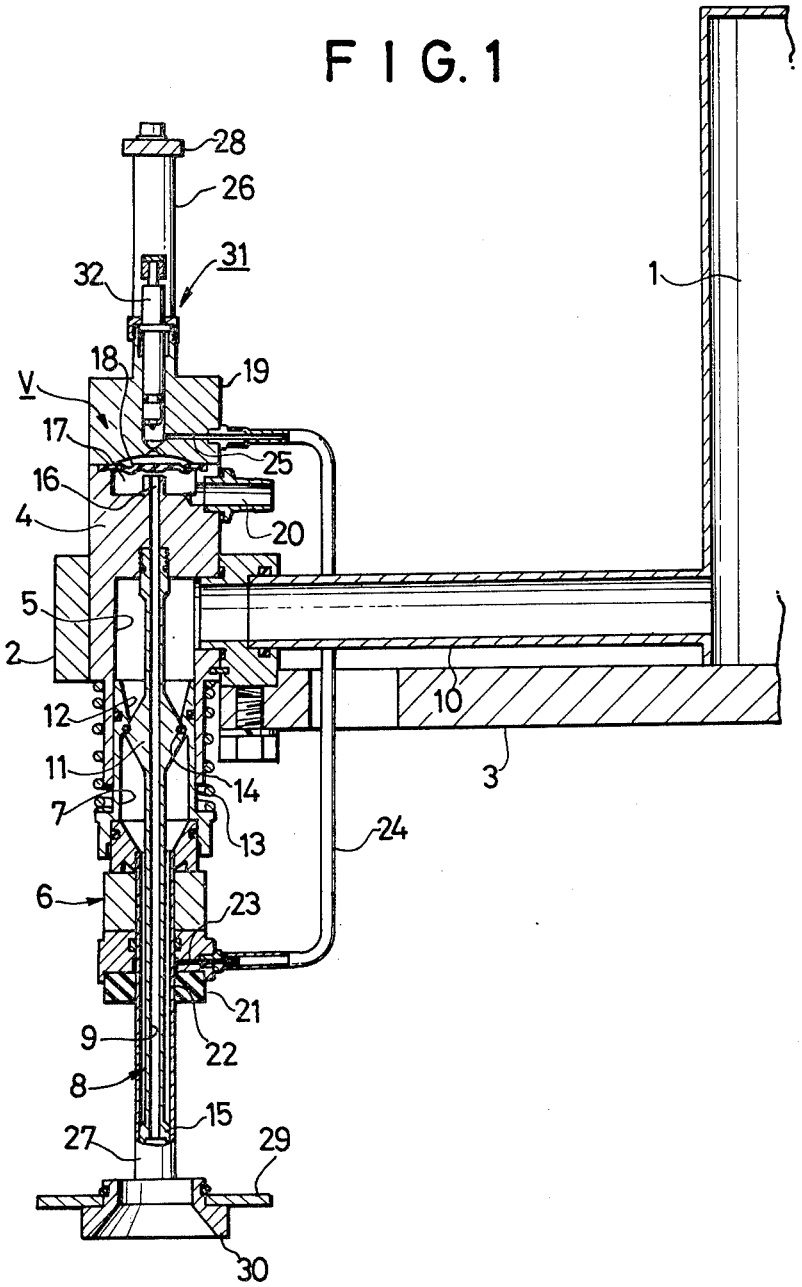
FIG. 1 is a vertical cross-sectional view of an embodiment of the present invention.
Figure 2:
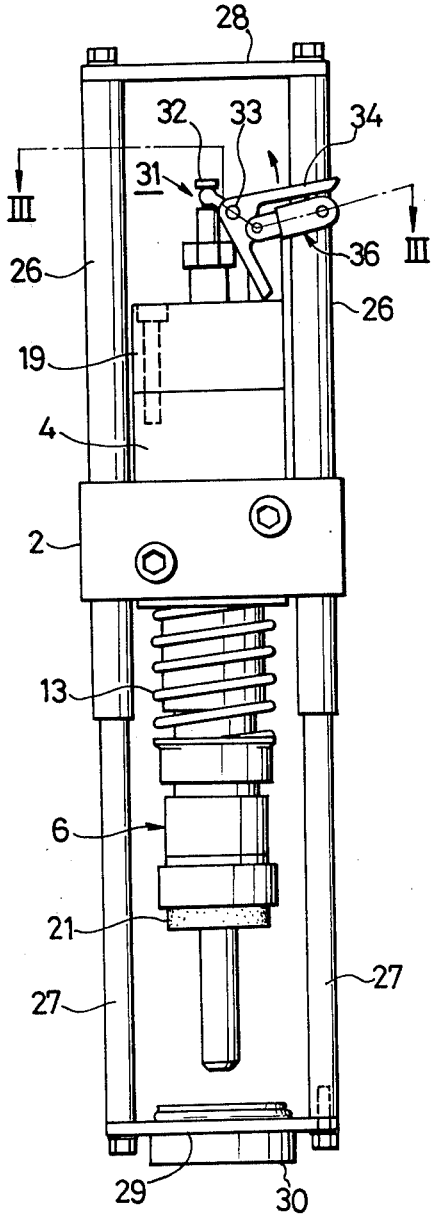
FIG. 2 is a left side elevation of the same.
Figure 3:
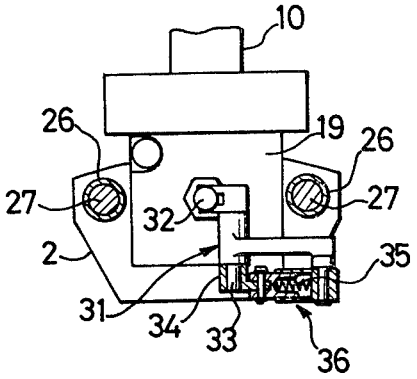
FIG. 3 is a cross-sectional view of a portion of the above embodiment which is taken along the line III—III in FIG. 2.

In FIGS. 1 to 3, a reservoir tank 1 contains a liquid which is to be filled into bottles by the filling device of the present invention. The tank 1 is supported by a supporting plate 3. Integrally attached to the supporting plate 3 is a supporting member 2 which carries a cylindrical member 4. In this cylindrical member 4, a hole 5 is defined which has a bottom on one side and the open end of the hole 5 is oriented vertically downward. A filling tube 6 is composed of a plurality of component members and is provided therethrough with a filling hole 7. An exhaust tube 8 having an exhaust passage 9 is disposed along the axis of the filling tube 6. The top end of this exhaust tube 8 is attached to the uppermost end wall of the above-mentioned hole 5. The upper portion of the filling tube 6 is slidably fitted into the hole 5. The tank 1 communicates with the hole 5 through a conduit 10, thereby passing the filling liquid in the tank 1 into a bottle (not shown) by way of the conduit 10, hole 5 and filling hole 7. In the upper portion of the exhaust tube 8, the outer peripheral wall is partially enlarged to form a valve seat 11 in a conical shape and the upper inner wall of the filling tube 6 is protruded to form a valve member 12 which receives the valve seat 11. The filling tube 6 is urged downward by a spring 13 which is disposed between the cylindrical member 4 and the filling tube 6, thereby pressing the valve member 12 against the valve seat 11 and closing the filing hole 7. In order to perform the closing of the filling hole completely, the valve seat 11 is provided with a sealing member 14. Further, a valve member 15, which is brought into slidable contact with the inner wall of the filling tube 6, is formed around the lowermost end of the exhaust tube 8. Therefore, the filling liquid which remains in the filling hole 7 between the valve member 12 and the other valve member 15 can be prevented from dripping during the non-filling period.

Along the axial portion of the cylindrical member 4, a passage 16 is formed which communicates with the passage 9 formed in the exhaust tube 8. To the upper end face of the cylindrical member 4 is attached a supporting member 19 and there is defined a cavity 17 between the cylindrical member 4 and the supporting member 19. The above-mentioned passage 16 protrudes into the cavity 17 and a diaphragm 18 disposed within the cavity 17 is supported at its peripheral portion by the top face of the cylindrical member 4 and the bottom face of the supporting member 19. The open end of the passage 16 is opposed to the diaphragm 18 so that, as described later on, the passage 16 can be closed by the under surface of the diaphragm 18. Further, the cavity 17 which is closed by the diaphragm 18 is allowed to communicate with the outer air through the exhaust port 20 which is formed on the cylindrical member 4.

Figure 5:
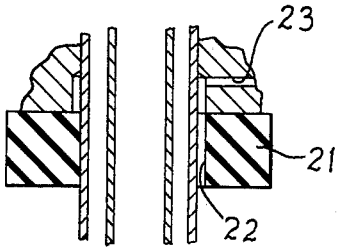
FIG. 5 is a view, on an enlarged scale, of a fragment of FIG. 1.

The reference numeral 21 denotes a sealing member which seals the opening of a bottle to be filled. The sealing member 21 is attached to the filling tube 6 and the lower portions of the filling tube 6 and the exhaust tube 8 are extended downward through the sealing member 21. Especially, the lower end face of the exhaust tube 8 is caused to coincide with the surface level of the liquid which is supplied into the bottle. In order to detect the pressure in the bottle, a detecting port 22 (FIG. 5) is formed in the sealing member 21 and this detecting port 22 is caused to communicate with the upper surface of the diaphragm 18 through an inner passage 23 that is formed in the filling tube, a conduit 24 and another inner passage 25 that is formed in the supporting member 19. Therefore, as described later, when the pressure within the bottle exceeds a certain value, the diaphragm 18 is shifted downward and the passage 16 is closed.

On both sides of the cylindrical member 4, the supporting member 2 is provided with a pair of guide sleeves 26 and each of the guide sleeves 26 receives therethrough a sliding rod 27. To the upper ends and the lower ends of the sliding rods 27 are respectively attached connecting plates 28 and 29. The lower connecting plate 29 is provided with a center guide 30 which is serviceable to align the center of the opening of a bottle with the axis of the filling tube 6 and the exhaust tube 8.

Further, a valve mechanism 31 closes the inner passage 25 during the washing step so as to avoid the action of pressure from the detecting port 22 to the diaphragm 18. This valve mechanism 31 is provided with a lever 34 and a holding mechanism 36. The lever 34 is pivotally secured to a pin 33 and with the turning of the lever 34, the interlocked valve body 32 is vertically moved to close or open the inner passage 25. The holding mechanism 36 is interlocked with the lever 34 and holds the lever 34 at the open position or closed position by the force of the spring 35.

The operation of the above-described filling device will be described in the following. When an empty bottle (not shown) is put on a supporting table and the bottle is raised up, the upper open end of the bottle is correctly guided to the center of the filling tube 6 by means of the center guide 30. When the opening of the bottle is brought into engagement with the filling tube 6, it is closed by the sealing member 21. With the further upward movement of the bottle, the filling tube 6 is pushed up against the force of the spring 13 while leaving the exhaust tube 8 as it stands. Thus the valve members 12 and 15 are opened and the filling liquid in the tank 1 is introduced into the bottle through the conduit 10, the hole 5 and the filling hole 7. Simultaneously with this operation, the air in the bottle is discharged through the exhaust passage 9, the passage 16, the cavity 17 and the exhaust port 20. In this step, the pressure which is introduced into the space on the upper side of the diaphragm 18 through the detecting port 22, the inner passage 23, the conduit 24 and the inner passage 25 becomes higher than the pressure on the lower side as much as the pressure caused by the flow resistance of the air discharged from the bottle which is determined according to the quantity of filling liquid and exhaust port 9. However, the pressure difference is not as large as to deform the diaphragm 19 against the elastic force thereof and to close the passage 16. In this embodiment of the present invention, since the air in the bottle is not exhausted into the reservoir tank 1, it is advantageous from the sanitary viewpoint as compared with the conventional water-head type filling machine.

When the exhaust passage 9 is blocked by the liquid surface by continuing the filling of the liquid, the pressure in the remaining space of the bottle is abruptly raised as much as the pressure which corresponds to the difference in height between the liquid surface in the bottle and the liquid surface in the tank 1. Therefore, the pressure in the space on the upper side of the diaphragm 18 is also raised and the diaphragm 18 is deformed downward to close the passage 16. In this state, the flow of filling liquid from the filling tube 6 into the bottle is stopped. In addition, the filling liquid does not enter into the exhaust passage 9.

In the next step, when the bottle is lowered, the filling tube 6 is also moved down by the force of the spring 13 in which the opening of the bottle is still closed by the sealing member 21. Thus, the above-mentioned valve members 12 and 15 are closed. When the bottle is further lowered and the sealing of the opening of the bottle with the sealing member 21 is released, the pressure on the upper side of the diaphragm 18 becomes the same as atmospheric pressure so that the stoppage of the passage 16 by the diaphragm 18 is released and a small quantity of filling liquid which has been introduced into the exhaust passage 9 during the short time between the blocking of the exhaust passage 9 by the liquid surface and the closing of the passage 16 by the diaphragm 18, is dropped into the bottle.

Figure 4:
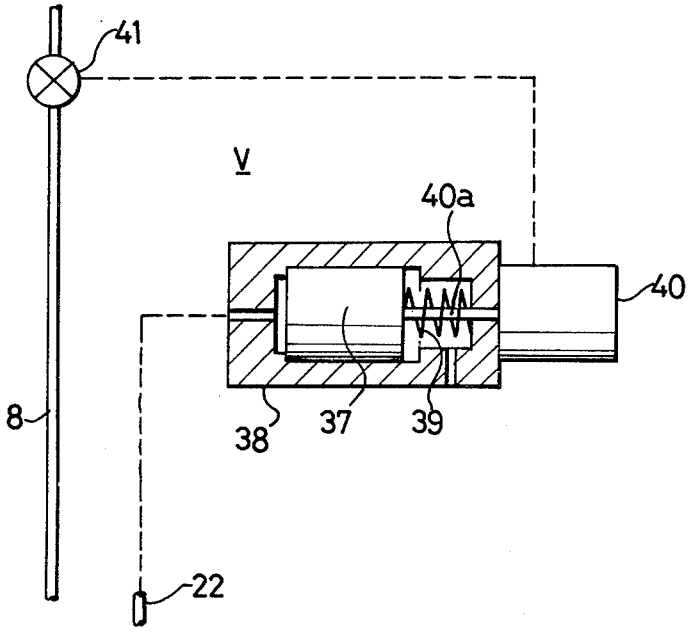
FIG. 4 is a schematic cross-sectional view of the main portion of another embodiment of the invention.

In the above-described embodiment, the valve mechanism V to close the exhaust tube 8 is composed of the diaphragm 18 and the passage 16. However, it should be noted that it is possible to use any other kind of valve mechanism which is able to close the exhaust tube 8 when the indication pressure received from the space in the bottle exceeds a certain level. Shown in FIG. 4 is another embodiment of the valve mechanism V in which a plunger 37 is slidably held in a casing 38 and is urged in one side direction by a spring 39. The reference numeral 40 denotes a limit switch which is provided with a probe 40a that detects the action of the plunger 37. The limit switch 40 is electrically connected to a solenoid valve 41 which is attached to the exhaust tube 8. The indication pressure from the detecting port 22 is led into the casing 38. Accordingly, when the indication pressure from the detecting port 22 exceeds a certain value, the plunger 37 is actuated by the indication pressure against the force of the spring 39 and the action of the plunger 37 is detected by the probe 40a of the limit switch 40, thereby closing the solenoid valve 41. Furthermore, in such a valve mechanism, the solenoid valve 41 can be maintained closed until a new empty bottle is delivered below the filling tube 6 by providing the mechanism with a timer circuit and a detecting switch which detects the new empty bottle. Therefore, if the solenoid valve 41 is opened after the delivery of the new bottle, it is possible to retain the remaining liquid in the exhaust tube 8 and to fill the liquid into the new empty bottle before it is filled with the filling liquid that is supplied from the filling tube 6.

Still further, the filling liquid is flowed into the bottle by gravity. However, the present invention can be applied to other various kinds of filling machines such as a pressure filling machine having a pressurized tank a pump filling machine having no reservoir tank and a filling machine in which the closing and opening of a filling tube is performed by a switch cock. In the case of a pressure filling machine, since the pressure has an influence more or less on the working of the valve mechanism V, the setting conditions of the valve mechanism must be determined with taking such influence into consideration. In the case of the filling of viscous liquid, pressure filling by a pressure filling machine or vacuum filling is generally employed in the conventional art and since the filling liquid overflows from the exhaust tube, it is necessary to re-treat the overflow liquid. It should be noted, however, that such treatment is not necessary at all when the filling device of the present invention is used. Further, when the filling tube is opened and closed by a switch clock, it is necessary for closing the bottle opening during the filling that the indication pressure only exceeds a predetermined value, therefore, the possiblity for filling plastic bottles and the like is raised. Further, in the case that both the filling liquid and $N_2$ gas must be inclosed, a three-way solenoid valve is used as the above-mentioned solenoid valve 41 and the air in the bottle is displaced with $N_2$ gas by switching the three-way solenoid valve just before the closing of the bottle opening and then the filling liquid is supplied in like manner as the above procedure. With the same measure, it is possible to clean up the inside of the filling tube 6 by supplying the filling tube 6 with cleaning air.

Figure 6:
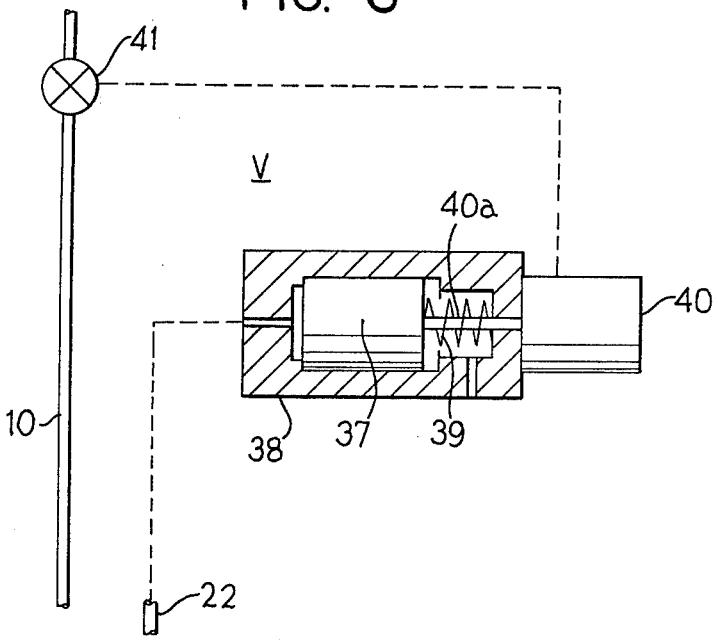
FIG. 6 is a schematic cross-sectional of the main portion of a third embodiment of the invention.

Besides the foregoing valve mechanism of the valve seat 11 and the valve member 12 for opening and closing the filling tube 6, the valve mechanism V shown in FIG. 4 can be used for controlling the filling tube 6, in which the filling action of the filling tube 6 to the bottle is stopped by actuating the valve mechanism V by the pressure of the remaining space in the bottle obtained when the filling liquid blocks the exhaust passage 9. This modification is illustrated in FIG. 6, wherein the valve V closes the solenoid valve 41 which is attached to the conduit 10. Furthermore, with the provision of a timer circuit or a detecting switch which detects the engagement of the valve member 12 with the valve seat 11, it is also possible to open the valve mechanism V after the valve member 12 is brought into engagement with the valve seat 11.

In the filling device of the present invention as described above, it receives the pressure in the bottle to be filled as an indication pressure and when the pressure exceeds a predetermined value, the valve mechanism closes the exhaust tube or the filling tube. Therefore, the filling device of the invention is free from the influence of the liquid level of the reservoir tank and the exhaust tube is not filled with the filling liquid when the supply flow of filling liquid is stopped. In addition, the filling operation can be carried out accurately in a short time, which are different from the conventionally used filling machines.

Although the present invention has been described in connection with preferred embodiments thereof, many variations and modifications will now become apparent to those skilled in the art of the technical field of this invention. It is preferred, therefore, that the present invention be limited not by the specific disclosure herein but only by the appended claims.

What is claimed is:

1. An apparatus for filling bottles having open mouths, which comprises:

a source of liquid to be filled into bottles;

a filling tube having an upper portion in liquid flow communication with said source and a lower portion receivable through the open mouth of a bottle so that liquid can flow from said source through said filling tube into the bottle;

an exhaust tube extending through said filling tube, the lower end of said exhaust tube being adapted to extend into and communicate with the interior of the bottle and the upper end of said exhaust tube being adapted to communicate with the ambient atmosphere so that air can be discharged from the bottle while the bottle is being filled with the liquid;

a sealing member surrounding said filling tube and adapted for sealing the perimeter of the open mouth of the bottle;

means defining pressure detecting port means located and arranged to communicate with the interior of the bottle when said bottle is sealed by said sealing member so that the internal pressure of the bottle is applied to said port means;

a first valve movable between open and closed positions for controlling the flow of liquid from said source into the bottle and means connecting said first valve for actuation to its closed position in response to an increase of pressure at said port means, caused when the level of the liquid in the bottle has risen so as to block the lower end of said exhaust tube, whereby to stop flow of liquid into the bottle.

2. An apparatus as claimed in claim 1 wherein said filling tube and said sealing member are mounted for conjoint vertical upward sliding movement in response to engagement with the mouth of the bottle, said exhaust tube is stationary and includes a second valve for closing the lower end of said filling tube until said filling tube is moved upwardly relative to said exhaust tube in response to engagement with the mouth of the bottle, and a third valve disposed between the upper and lower portions of said filling tube, said third valve comprising a valve member on the inside of said filling tube and movable therewith and a stationary valve seat on the exterior of said exhaust tube and sealingly engageable with said valve member until said filling tube is moved upwardly relative to said exhaust tube.

3. An apparatus as claimed in claim 2 in which the upper end of said exhaust tube is disposed outside of and out of communication with said source of liquid so that the air from the bottle is not discharged into said source of liquid.

4. An apparatus as claimed in claim 1, claim 2 or claim 3 in which said first valve comprises a cavity having a flexible diaphragm extending thereacross and dividing said cavity into two chambers, the upper end of said exhaust tube communicating with one of said chambers, conduit means connecting said port means to the other of said chambers so that the pressure applied at said port means is transmitted to said other chamber and is applied to one side of said diaphragm, said one chamber having an exhaust port extending therefrom to the ambient atmosphere, said diaphragm being deformable into sealing engagement with the upper end of said exhaust tube in response to said increase of pressure at said port means whereby to block discharge of air from the bottle and thereby discontinue flow of the liquid into the bottle.

5. An apparatus as claimed in claim 1, claim 2 or claim 3 including a plunger slidably disposed in a casing, a spring urging said plunger in one direction, conduit means connecting said port means to said casing so that said plunger is moved in the opposite direction in response to said increase of pressure at said port means, a limit switch operated by said plunger, and said first valve being an electrically operated valve responsive to operation of said limit switch.

6. An apparatus as claimed in claim 5 wherein said first valve is mounted in said exhaust tube for opening and closing said exhaust tube.

7. An apparatus as claimed in claim 5 wherein said first valve is mounted between said source and said filling tube.

* * * * *